US005803816A

United States Patent [19]

Moser et al.

[11] Patent Number: 5,803,816

[45] Date of Patent: Sep. 8, 1998

[54] AMUSEMENT RIDE

[75] Inventors: Alfeo Moser; Claudio Soriani, both of Melara, Italy

[73] Assignee: Soriani & Moser, Melara, Italy

[21] Appl. No.: 544,685

[22] Filed: Oct. 18, 1995

[30] Foreign Application Priority Data

Oct. 19, 1994 [IT] Italy ..... B094 A 000459

[51] Int. Cl.[6] ..... A63G 27/04

[52] U.S. Cl. ..... 472/46; 472/44

[58] Field of Search ..... 472/44, 45, 46, 472/3, 29, 30, 31, 32

[56] References Cited

U.S. PATENT DOCUMENTS 4,643,416 2/1987 van der Veen ..... 472/45
4,807,869 2/1989 Knijpstra ..... 472/45
5,188,566 2/1993 Böhme ..... 472/45
5,314,283 5/1994 Fabbri ..... 472/45

FOREIGN PATENT DOCUMENTS 5154256 6/1993 Japan ..... 472/45

*Primary Examiner*—Kient T. Nguyen
*Attorney, Agent, or Firm*—Royston Rayzor Vickery Novak & Druce

[57] ABSTRACT

An amusement ride presenting a platform, two parallel vertical posts extending upwards from the platform, and two arms fitted respectively to the posts and rotated about a horizontal axis by a first drive means. The ride is characterized in that it presents a passenger car in turn presenting a circular supporting structure fitted to an axial end of the two arms, a circular plate fitted to the structure and rotated freely about its own central axis by a second drive means and a number of seats fitted to the plate.

12 Claims, 4 Drawing Sheets

AMUSEMENT RIDE

BACKGROUND OF THE INVENTION

The present invention relates to an amusement ride featuring a passenger car with a number of novel movements.

SUMMARY OF THE INVENTION

It is an object of the present invention to provide an amusement ride featuring a passenger car with a number of novel movements.

According to the present invention, there is provided an amusement ride comprising a platform, two parallel vertical posts extending upwards from the platform, and two arms fitted to respective said posts and rotated about a horizontal axis by first drive means. The amusement ride further comprises a passenger car presenting a circular supporting structure fitted to an axial end of said arms, a circular plate fitted to said structure and rotated freely about its own central axis by second drive means, and a number of seats fitted to said plate.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
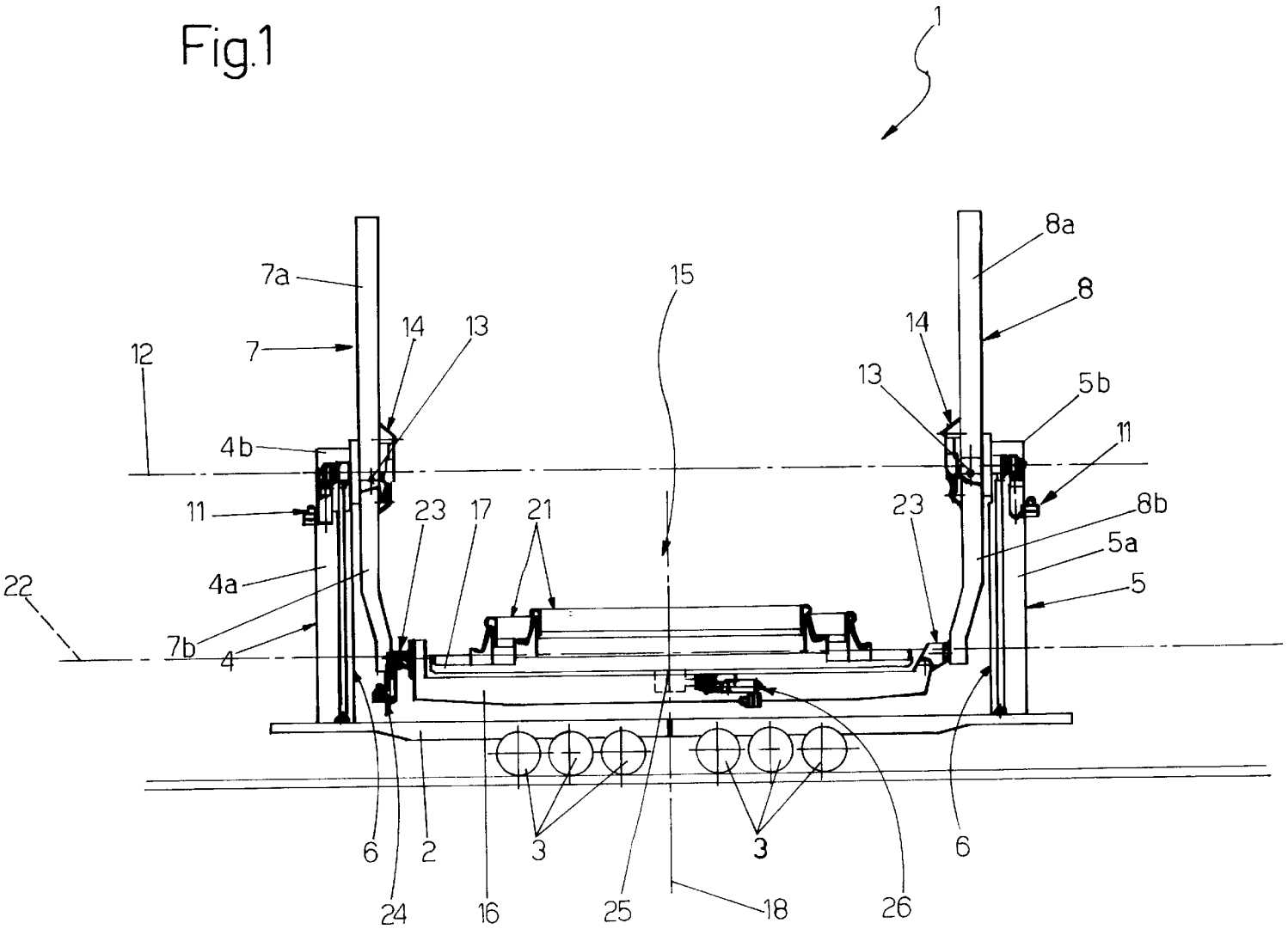
FIG. 1 shows a side view of an amusement ride in accordance with the teachings of the present invention.
Figure 3:
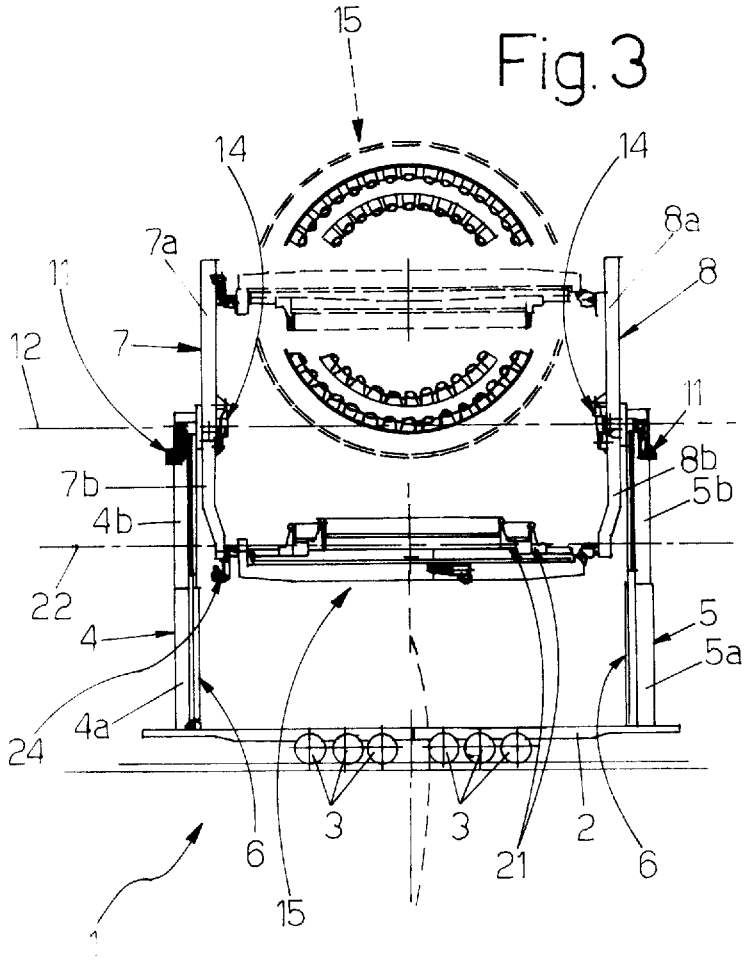
FIGS. 3 and 4 show smaller-scale side views of the FIG. 1 ride in various operating positions.

Number 1 in FIG. 1 indicates an amusement ride comprising a platform 2 resting on the ground on a number of wheels 3 used mainly for transferring ride 1, which, in use, is anchored to the ground by known anchoring systems (not shown). Ride 1 also comprises two parallel, vertical, telescopic posts 4, 5 extending upwards from opposite axial ends of platform 2, and each formed in two parts: a fixed first part 4*a*, 5*a* integral with platform 2, and a second part 4*b*, 5*b* movable between a withdrawn position (FIG. 1) and an extracted position (FIG. 3). In the withdrawn position, the second part 4*b*, 5*b* is housed almost entirely inside the respective first part 4*a*, 5*a*, and is extracted to a given height and coaxially with the respective second part 4*b*, 5*b* by a respective hydraulic actuator 6. Actuators 6 are fitted to platform 2, and each present an axially-sliding rod integral with a respective second part 4*b*, 5*b*.

As shown in FIG. 1, at the top end, posts 4 and support respective arms 7 and 8 rotated by known drive means 11 about a horizontal axis 12. Arms 7, 8 comprise respective portions 7*a*, 8*a* pivoting on said top ends of respective posts 4, 5 and therefore rotated solely about axis 12; and respective portions 7*b*, 8*b* hinged to respective portions 7*a*, 8*a*, and which are rotated together with respective portions 7*a*, 8*a* about axis 12, and are also rotated about their own hinge axis 13 by respective hydraulic actuators 14 fitted to respective portions 7*a*, 8*a* and presenting respective sliding rods hinged at one end to respective portions 7*b*, 8*b*.

Figure 2:
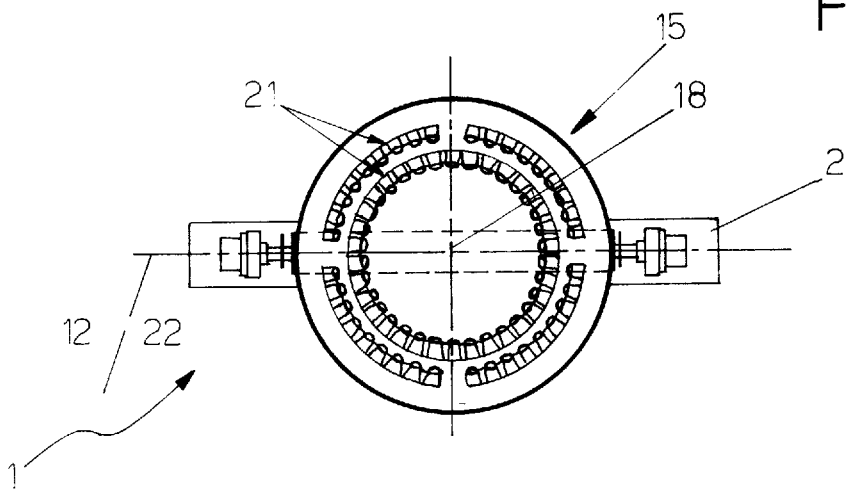
FIG. 2 shows a smaller-scale plan view of the FIG. 1 ride.

As shown in FIGS. 1 and 2, ride 1 also comprises a passenger car 15 presenting a circular supporting structure 16, a circular plate 17 fitted to structure 16 and rotating freely about its own central axis 18, and two circular rows 21 of seats fitted to plate 17. Car 15 is fitted to arms 7 and 8, and in particular to portions 7*b* and 8*b*. More specifically, along its diametrical axis 22, structure 16 presents two known articulated joints 23 connecting it to the free ends of portions 7*b* and 8*b*, and permitting it to rotate freely about axis 22 during operation of ride 1. In actual use, structure 16 may be rotated about axis 22 either by known drive means 24 fitted to portion 7*b* of arm 7, or by nonsynchronously rotating arms 7 and 8. A rotary shaft 25 supporting plate 17 extends along axis 18 of structure 16; and rotation of plate 17 about axis 18 is controlled by known drive means 26 fitted to structure 16.

With reference to FIGS. 1, 2, 5 and 6, rows 21 are concentric and defined by a number of seats facing either outwards (FIG. 5) or inwards (FIG. 6); and each seat presents a known safety system (not shown) for securing the passenger to the seat during operation of ride 1.

In actual use, ride 1 may perform two distinct operating cycles, which differ solely as regards the manner in which car 15 is permitted to rotate about axis 22.

FIG. 3 shows three possible positions of car 15 in a first operating cycle, which successively provides for:

- rotating plate 17 about axis 18 by means of drive means 26;
- raising parts 4*b* and 5*b* into the extracted position by means of actuators 6;
- rotating arms 7 and 8 synchronously and parallel to each other by means of drive means 11; and
- by means of drive means 24, rotating the whole car 15 about axis 22, upon car 15 being rotated by arms 7 and 8 into the topmost position.

Figure 4:
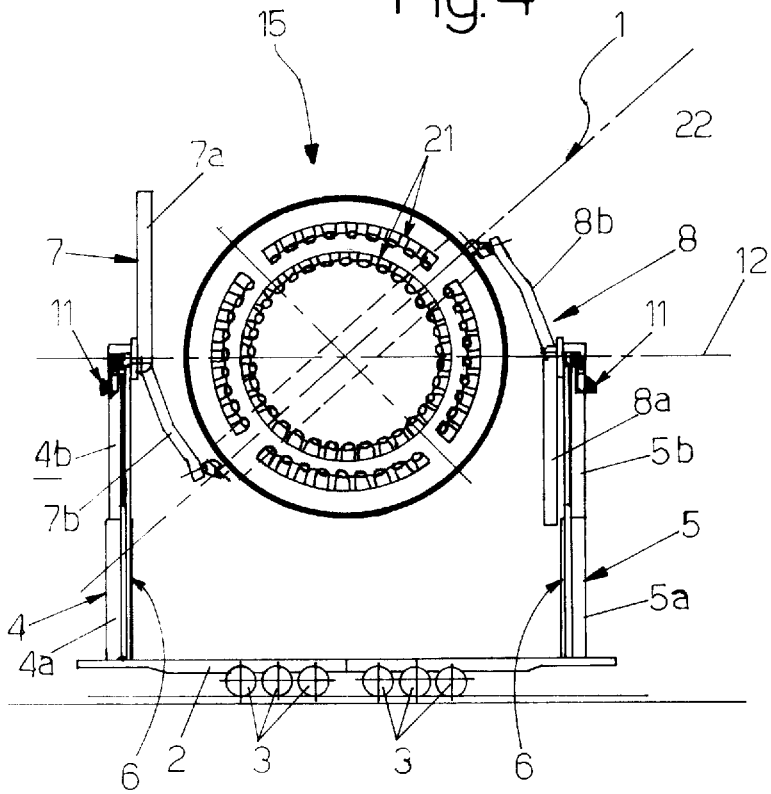
Figure 5:
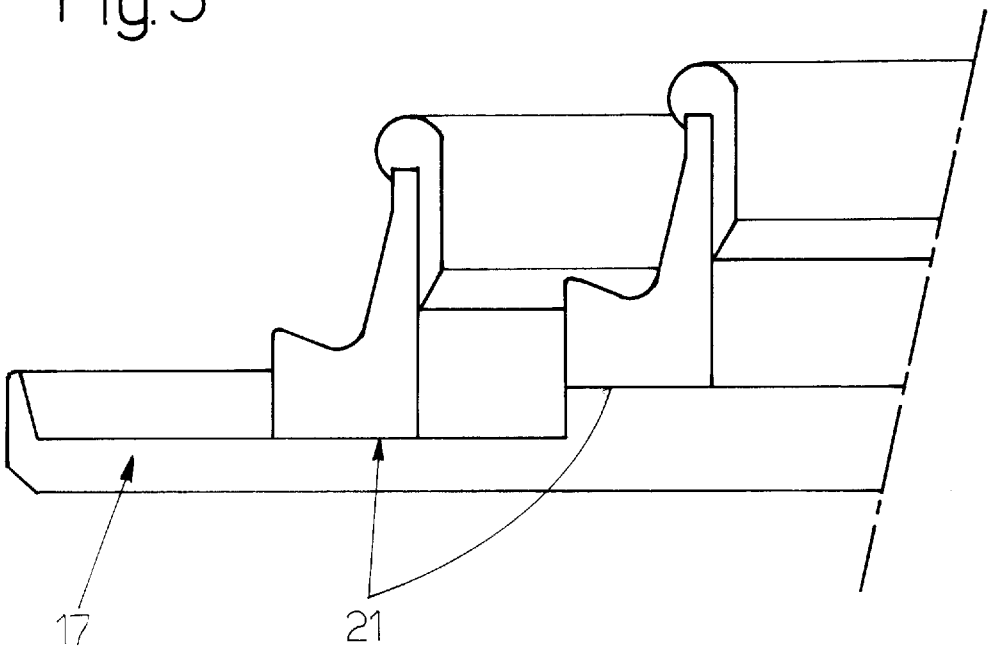
FIGS. 5 and 6 show partial, larger-scale views of two embodiments of a detail of the FIG. 1 ride.
Figure 6:
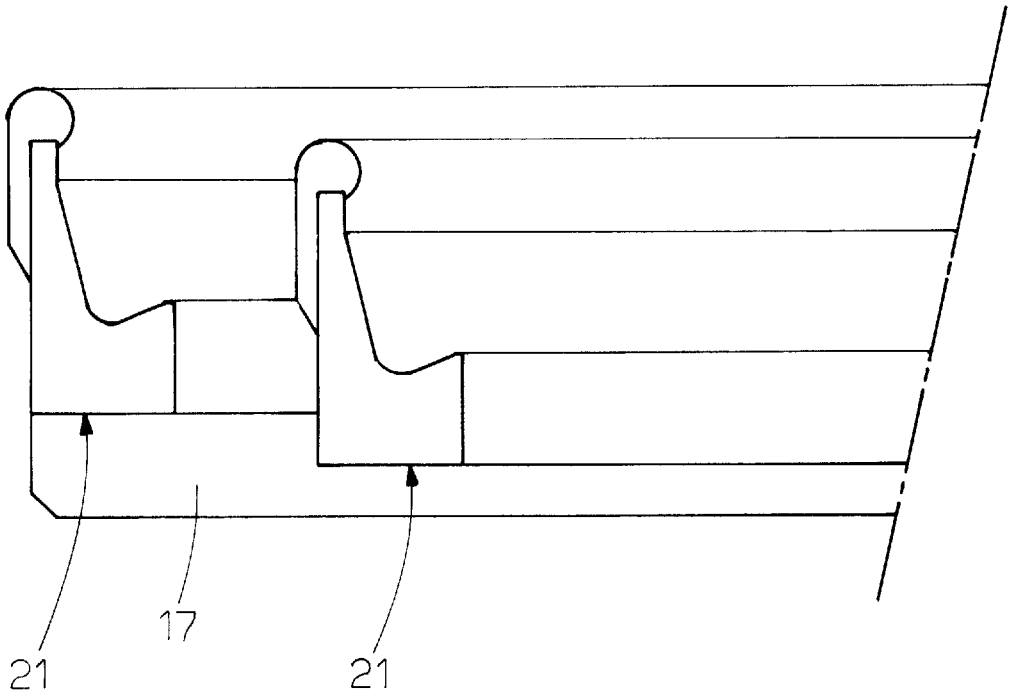

FIG. 4 shows a further position of car 15 in a second operating cycle, which successively provides for:

- rotating plate 17 about axis 18 by means of drive means 26;
- raising parts 4b and 5b into the extracted position by means of actuators 6;
- rotating arms 7 and 8 nonsynchronously by means of drive means 11;
- rotating portions 7*b* and 8*b* about respective hinge axes 13 by means of actuators 14, so that, as arms 7 and 8 are rotated nonsynchronously, the distance between the ends of portions 7*b* and 8*b* supporting car 15 is maintained constant; and
- rotating the whole car 15 about axis 22 as a consequence of the nonsynchronous rotation of arms 7 and 8.

Ride 1 may of course also perform more complex operating cycles, e.g. comprising steps of the above cycles. For example, in the second cycle described above, car 15 may also be rotated by rotating arms 7 and 8 at different speeds, or, in certain positions, by means of drive means 24.

We claim:

1. An amusement ride comprising:

a platform;

two parallel vertical posts extending upwards from the platform two arms fitted to respective said posts and rotatable about a horizontal axis by a first drive; and a passenger car presenting a circular supporting structure fitted to an axial end of said arms, a circular plate fitted to said structure and rotatable freely about said plate's own central axis by a second drive, and a number of seats fitted to said plate.

2. A ride as claimed in claim 1, wherein:

said posts are telescopic, and each comprises a fixed first part integral with said platform and a second part movable between a withdrawn position and an extracted position; and said second part is movable from the withdrawn to the extracted position by a first actuator.

3. A ride as claimed in claim 2, wherein said second part is coaxially extendable to a given height.

4. A ride as claimed in claim 3, wherein said actuator comprises a hydraulic actuator.

5. A ride as claimed in claim 1, wherein each said arm comprises:

a first portion pivotable on one end of the respective said post and therefore only rotatable about said horizontal axis;

a second portion hinged in a second axis to the respective said first portion, and which is rotatable, together with the respective said first portion, about said horizontal axis, and is rotatable about said second axis by a second actuator; and wherein said car is fitted to the free ends of said second portions.

6. A ride as claimed in claim 5, further comprising a third drive fitted to one of said arms and for rotating said car about said car's diametrical axis.

7. A ride as claimed in claim 5, wherein said actuator comprises a hydraulic actuator.

8. A ride as claimed in claim 1, wherein said seats are formed in two concentric rows and face outward from the car.

9. A ride as claimed in claim 1, wherein said seats are formed in two concentric rows and face inward toward the car.

10. A method for operation of an amusement ride, comprising the steps of:

rotating a circular plate about said plate's central axis where said plate is supported by two arms and said two arms are supported by two extendable posts;

raising said circular plate by extending said extendable posts;

rotating said arms relative to said extendable posts; and rotating said circular plate about said plate's diametrical axis.

11. The method for operation of an amusement ride as claimed in claim 10, wherein in said rotating arms step each said arm is rotated substantially synchronously with, and substantially parallel to, the other said arm.

12. The method for operation of an amusement ride as claimed in claim 10, wherein in said rotating arms step each said arm is rotated non-synchronously with the other said arm.

* * * * *